United States Patent [19]

Schnettler et al.

[11] Patent Number: 4,724,165

[45] Date of Patent: Feb. 9, 1988

[54] PROCESS AND APPARATUS FOR COATING METAL STRIPS ON BOTH SIDES WITH COATS OF ENAMEL

[76] Inventors: Roland Schnettler, Schwerter Strasse 138, 5800 Hagen; Hans J. May, Ulmenweg 17, 5860 Iserlohn, both of Fed. Rep. of Germany

[21] Appl. No.: 912,311

[22] Filed: Sep. 29, 1986

[30] Foreign Application Priority Data

Oct. 9, 1985 [DE] Fed. Rep. of Germany ..... 3536040

[51] Int. Cl.[4] ..... B05D 1/18

[52] U.S. Cl. ..... 427/193; 427/376.2; 427/376.4; 427/379; 427/380; 427/419.3; 427/419.4

[58] Field of Search ..... 427/193, 190, 376.2, 427/376.4, 379, 380, 419.3, 419.4; 118/66, 67

[56] References Cited

U.S. PATENT DOCUMENTS

| | | | |
|---|---|---|---|
| 2,989,418 | 6/1961 | Harbaugh | 427/380 X |
| 3,096,567 | 7/1963 | Ross et al. | 118/67 X |
| 4,429,007 | 1/1984 | Bich et al. | 427/380 X |

FOREIGN PATENT DOCUMENTS 667023 10/1938 Fed. Rep. of Germany .

OTHER PUBLICATIONS

*Sprechsaal fur Keramik, Glas, Email,* 1963, pp. 202–206.

*Primary Examiner*—Shrive P. Beck

*Attorney, Agent, or Firm*—Collard, Roe & Galgano

[57] ABSTRACT

A process and apparatus for coating metal strips on both sides with an enamel base coat and on at least one side thereof with an enamel top coat by continuously passing such strips in a contactless manner through baking furnaces. For the heat treatment following the coating step, the metal strips are vertically admitted into a baking furnace, and vertically guided through the baking furnace.

1 Claim, 1 Drawing Figure

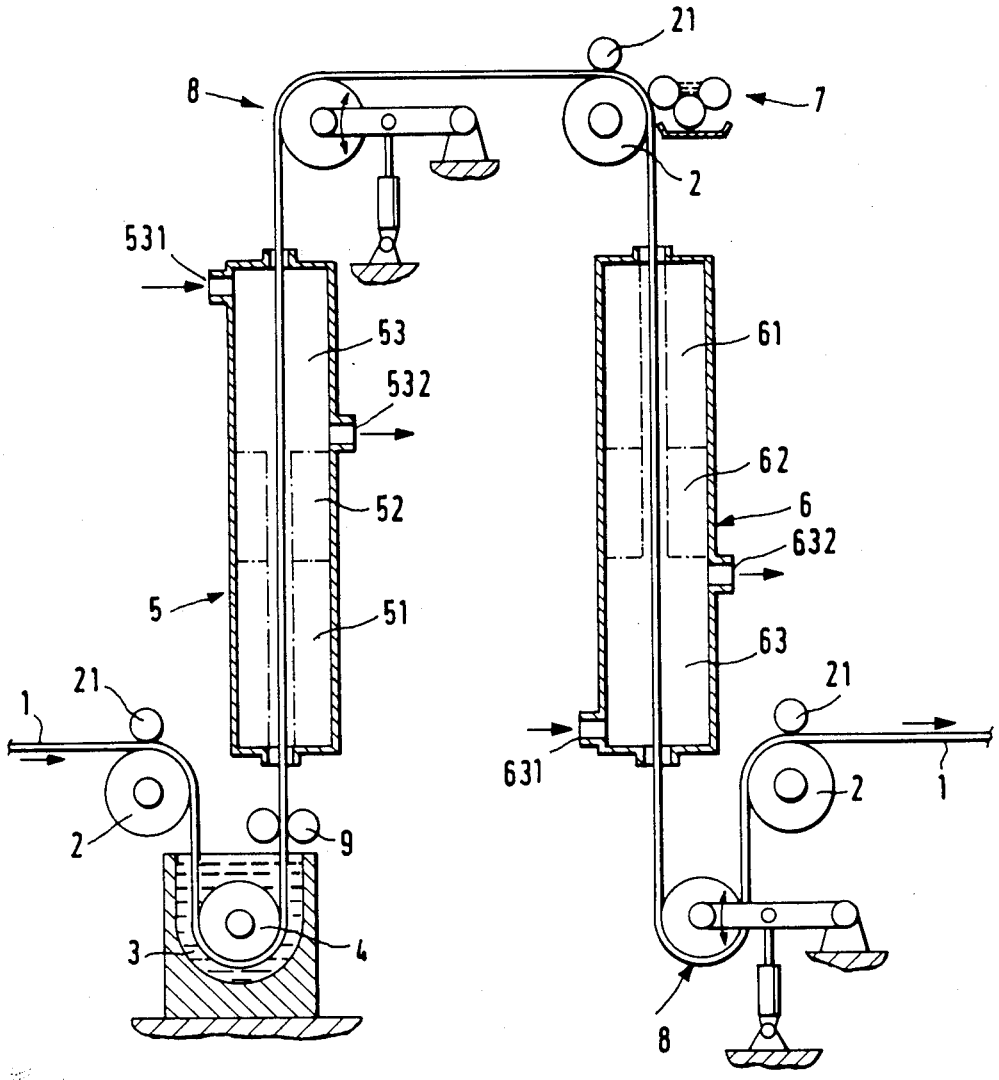
21
8
7
2
531
53
532
52
5
51
61
62
6
632
63
631
21
1
2
9
3
4
21
2
1
8

PROCESS AND APPARATUS FOR COATING METAL STRIPS ON BOTH SIDES WITH COATS OF ENAMEL

BACKGROUND OF THE INVENTION

The invention relates to a process and apparatus for coating metal strips on both sides with an enamel base coat and, at least on one side, with an enamel top coat applied over the base coat, by continuously passing the strips in a contactless manner through furnaces with heating and cooling zones.

A process is known in which the metal strips, which are coated on both sides, preferably with a slurry for producing an enamel base coat, are continuously passed through a horizontal furnace with a preheating zone, a baking zone and a subsequent cooling zone. As a rule, an enamel base coat is applied first to both sides of the metal strip in a first furnace and an enamel top coat made of slurry or powder is subsequently applied to one side of the strip in a second baking furnace of the same type.

Due to the fact that the metal strips are horizontally guided at baking temperatures in the furnace ranging from 700° to 900° C., the freely suspended loop in the furnace sags considerably. Thus, the maximum length of the baking furnace is limited by the tensile load on the strip in the freely suspended loop. Furthermore, this results in different spacings relative to the burners or burner tubes, which are arranged in the furnace in the longitudinal direction of a fixed, predetermined curve of sag. As a result, a constant baking temperature and uniform enamel quality cannot always be assured at high operating speeds of the equipment. Furthermore, the inlet and outlet openings on the baking furnace have to be dimensioned relatively large, so that such furnaces have high heat losses. Moreover, the efficiency of such a plant is relatively low due to the limited length of the furnace.

Accordingly, it is an object of the invention to provide a more efficient and qualitatively enhanced process and apparatus for coating strips on both sides with an enamel base coat and at least on one side with an enamel top coat.

SUMMARY OF THE INVENTION

This object is achieved according to the invention by the provision of a process and apparatus for coating metal strips on both sides with an enamel base coat and an enamel top coat to be applied to at least one side thereof by continuously passing the strips in a contactless manner through baking furnaces with heating and cooling zones. The process is characterized in that for the heat treatment following the coating step, the metal strips are vertically admitted into the baking furnace and vertically fed therethrough.

According to a preferred embodiment of the invention, such a process is characterized in that the strips, on coating with a slurry or powder for producing the enamel base coat, are passed through a first vertically-disposed baking furnace, advancing from the bottom to the top of the furnace, and following their path reversal and subsequent coating with a slurry or powder for producing the enamel top coat, through a second vertically-disposed baking furnace, advancing from the top to the bottom thereof.

By vertically admitting the metal strips after the coating into the baking furnace and passing them vertically through the furnace, the coating remains free from contact until it is cured after passing through the cooling zone, so that damage of any type is avoided. By guiding the coated strips vertically in the baking furnace, a constant spacing can be maintained between the strip and the burners of the furnace, assuring uniform baking of the coating. In a vertical furnace, the temperature can be controlled more favorably for optimizing the temperature/time curves for the baking process. The cross section of the inlet and outlet gates of such a vertical furnace can be kept much smaller than with horizontal furnaces, so that the heat losses are lower. Furnaces with a greater passage length can be used in order to achieve higher strip speeds and thus higher output rates of a plant for carrying out the process according to the invention. As no sagging of the strip to be treated occurs in the process of the invention, the tensile stress of the strip can be adjusted to much more favorable values, which has a favorable bearing on the flatness of the strip. If the strip should tear, the lead end of the strip can be admitted in a faster and safer way as compared to the known horizontal equipment.

Other objects and features of the present invention will become apparent from the following detailed description considered in connection with the accompanying drawing, which discloses one embodiment of the invention. It is to be understood that the drawing is to be used for the purpose of illustration only, and not as a definition of the limits of the invention.

BRIEF DESCRIPTION OF THE DRAWING

The drawing is a schematic side view of the apparatus for carrying out the inventive process.

DETAILED DESCRIPTION OF THE DRAWING

In the drawing, a horizontally advancing pretreated metal strip is directed downwardly via the reversing drive roll 2 and cooperating pinch wheel 21, and guided into the slurry bath 3 where it receives an enamel base coating. Strip 1 is guided around roll 4 to reverse its advancement direction and metal strip 1 (now coated on both sides) is subsequently admitted in the vertical direction into the first baking furnace 5. Stripper rolls 9 are mounted ahead of the baking furnace 5 to guide the strip and remove any excess coating.

First, preheating takes place in the preheating zone 51 of the furnace 5, which is followed by the baking zone 52, in which the closed, glassy enamel base coating is fused at the suitable baking temperatures. In the cooling zone 53 following the baking zone, cooling takes place preferably by a countercurrent of cool air which is admitted via the inlet 531 and exhausted by way of the outlet 532.

The metal strip 1 so provided with the cured enamel base coat is reversed controlled by tensile stressing via the roll device 8 and admitted into a second baking furnace 6. This time, however, strip 1 travels from the top to the bottom of the baking furnace, again in the vertical direction, via a second drive roll 2 and pinch wheel 21. Before entering this furnace 6, strip is coated on one side with slurry or powder for producing the enamel top layer, for example by roll application, spraying, or electrostatic application. This process permits the production of coatings on one or both side(s).

While the strip is guided in the first baking furnace 5 from the bottom to the top, metal strip 1 is guided in the second baking furnace 6 from the top downwardly and initially into the preheating zone 61. Subsequently, it is vertically guided downwardly into the baking zone 62 and, subsequently, again free from contact, into a cooling zone 63 having a cooling air inlet 631 and a cooling air outlet 632.

After its direction has been reversed on another roll device 8 with control of the tensile stress, the coated metal strip 1 is passed on via another controlled drive roll 2 cooperating with a pinch wheel 21.

The basic process of the invention permits the production of enamel coatings on one or both sides of the strip in one single vertical baking furnace as well. For example, the strip can be provided with both the enamel base and enamel top coats before it is admitted into the single baking furnace.

Thus, while only one embodiment of the present invention has been shown and described, it is obvious that many changes and modifications may be made thereunto, without departing from the spirit and scope of the invention.

What is claimed is:

1. In a process for coating a metal strip on both sides thereof with an enamel base coat and at least on one side thereof with an enamel top coat of the type including the steps of coating said metal strips with enamel and subsequently subjecting said strips to a heat treatment by passing said strips in a contactless manner through furnaces having a heating and cooling zone, the improvement comprising the steps of:

arranging two baking furnaces comprising a first baking furnace and a second baking furnace in a generally vertical direction;

initially coating said metal strip with a slurry or powder to produce an enamel base coat, vertically admitting said metal strips into said first baking furnace and vertically guiding said strips therethrough, with said strip entering from the bottom and exiting from a cooling zone at the top thereof, and heat-treating said coated metal strip while said strip is fed through said first vertically-arranged baking furnace;

further coating at least one side of said metal strip with a slurry or powder to produce an enamel top coat; and vertically admitting said metal strip into a second baking furnace and vertically guiding said strip therethrough, with said strip entering from the top, and exiting from a cooling zone at the bottom thereof, and heat-treating said coated metal strip while said strip is fed through said second vertically-arranged baking furnace.

* * * * *